US009650596B2

(12) United States Patent
Davis et al.

(10) Patent No.: US 9,650,596 B2
(45) Date of Patent: May 16, 2017

(54) NON-FLAMMABLE TERNARY CLEANING COMPOSITIONS

(71) Applicant: Illinois Tool Works Inc., Glenview, IL (US)

(72) Inventors: Milton Davis, Fayetteville, GA (US); Matthew Morris, Kennesaw, GA (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 142 days.

(21) Appl. No.: 14/828,121

(22) Filed: Aug. 17, 2015

(65) Prior Publication Data

US 2016/0060583 A1 Mar. 3, 2016

Related U.S. Application Data

(60) Provisional application No. 62/042,596, filed on Aug. 27, 2014.

(51) Int. Cl.
*C11D 7/50* (2006.01)
*C11D 17/00* (2006.01)

(52) U.S. Cl.
CPC ..... *C11D 7/5063* (2013.01); *C11D 7/5018* (2013.01); *C11D 17/0043* (2013.01)

(58) Field of Classification Search
CPC .... C11D 7/5059; C11D 7/504; C23G 5/02803
See application file for complete search history.

(56) References Cited

U.S. PATENT DOCUMENTS 6,423,673 B1 7/2002 Owens et al.
7,972,524 B2 7/2011 Robin
8,623,233 B2 1/2014 Robin et al.
8,680,037 B2 3/2014 Robin
2003/0220218 A1* 11/2003 Fitzgerald ..... C11D 7/5018 510/407
2003/0224956 A1 12/2003 Miller et al.
2011/0031436 A1 2/2011 Mahler et al.
2011/0144216 A1* 6/2011 Hulse ..... A01N 29/02 514/757
2013/0079267 A1* 3/2013 Marhold ..... C11D 7/5059 510/109
2013/0090280 A1 4/2013 Basu et al.
2013/0096218 A1* 4/2013 Rached ..... C09K 5/045 521/170
2013/0098396 A1* 4/2013 Lousenberg ..... C07C 21/18 134/6
2014/0083119 A1 3/2014 Rached
2014/0261565 A1 9/2014 Hulse et al.

FOREIGN PATENT DOCUMENTS

JP H1180791 A 3/1999

OTHER PUBLICATIONS

International Search Report and Written Opinion in PCT/US2015/045717 dated Nov. 2, 2015.

* cited by examiner

*Primary Examiner* — Gregory Webb
(74) *Attorney, Agent, or Firm* — Levenfeld Pearlstein, LLC

(57) ABSTRACT

A non-flammable ternary liquid cleaner is formulated from a first solvent that is a dichloroethylene, a second solvent that is a hydrofluorocarbon and a third solvent that is a fluoroketone having low flammability. The dichloroethylene is present in a concentration of at about 50 percent to about 60 percent by weight of the cleaner, the hydrofluorocarbon is present in a concentration of about 25 percent to about 35 percent by weight of the cleaner and the fluoroketone is present in a concentration of at about 13 percent to about 25 percent by weight of the cleaner.

11 Claims, No Drawings

NON-FLAMMABLE TERNARY CLEANING COMPOSITIONS

CROSS-REFERENCE TO RELATED APPLICATION DATA

This application claims the benefit of and priority to Provisional U.S. Patent Application Ser. No. 62/042,596, filed Aug. 27, 2014, the disclosure of which is incorporated herein in its entirety.

BACKGROUND

Cleaning solvents or cleaners are used during the manufacture and rework of electronic, telecommunications and other electrical equipment to clean the components prior to final assembly. These cleaners are also used during maintenance operations carried out on electrical equipment in order to provide for proper electrical conductivity where two conductive (e.g., metal) surfaces are to be joined to one another in electrical contact.

Cleaners can be used during the manufacture, maintenance, repair and assembly of printed circuit boards, connectors, relays and contacts, solenoids, motors and motor windings, circuit breakers, circuit breaker panels, transformers, electrical and data communication connectors and switching devices, electronic controls, timers, cable assemblies, splices and terminations, hydraulic and pneumatic equipment, magnetic read/write equipment, optical equipment and the like.

Typically, these cleaners are used to remove contaminants, and more particularly, flux, grease, light oils, corrosive contaminants, oxidation products and the like prior to a final assembly or during or after equipment and component maintenance.

Many such cleaners are provided in aerosol form. Aerosol cleaners typically include a solvent and a propellant. Aerosol formulations can contain constituents that render the formulation relatively flammable. And, the solvents, in and of themselves (e.g., without the propellant) are relatively flammable. This can be problematic in a manufacturing facility during fabrication or in a workplace when performing equipment and component maintenance. In addition, many of these aggressive solvents cannot be used with certain types of plastics due to their aggressive nature. Nevertheless, because of the aggressive cleaning characteristics of these formulations, for many applications their use continues.

One formulation, disclosed in Fitzgerald, U.S. Pat. No. 6,746,998, which is commonly assigned with the present application, discloses a formulation that exhibits lower flammability tendencies and sufficiently aggressive cleaning characteristics. However, greater demands are being made for cleaner formulations that exhibit lower environmental impact, and more specifically, lower global warming potential (GWP).

Accordingly, there exists a need for cleaning compositions having good cleaning characteristics and low flammability. Desirably, such a solvent has a high degree of plastic compatibility and is formulated so that it can be used as a liquid or, with the proper propellant, as an aerosol. More desirably still, such a cleaning solvent formulation has low GWP.

SUMMARY

A nonflammable ternary liquid cleaner is formulated from first, second and third solvents. The first solvent is a dichloroethylene, the second solvent is a hydrofluorocarbon and third solvent is a fluoroketone.

The first solvent, the dichloroethylene is present in a concentration of about 50% to about 60% by weight of the cleaner. The second solvent, the hydrofluorocarbon is present in a concentration of about 25% to about 35% by weight of the cleaner and the third solvent, the fluoroketone is present in a concentration of about 13% to about 25% by weight of the cleaner. The cleaner exhibits low to no residual flammability.

In one formulation, the first solvent is trans-1,2-dichloroethylene, the second solvent is trans-1-chloro-3,3,3-trifluoropropene and the third solvent is 1,1,1,2,2,4,5,5,5-nonafluoro-4-(trifluoromethyl)-3-pentanone. Alternatively, the second solvent can be methoxytridecafluoroheptene (HFX-110) or HFX-1100 (HFO-1336mzz) (Z)-1,1,1,4,4,4-hexafluorobut-2-ene; cis-1,1,1,4,4,4,-hexafluorobut-2-ene or a combination thereof.

The cleaner can be used as a liquid. Alternately, the cleaner can be formulated as an aerosol and includes a propellant. A preferred propellant is present in a concentration of about 1 percent to about 50 percent of a total weight of the cleaner and the propellant. A preferred propellant is an HFC liquefied gas, such as tetrafluoroethane (HFC-134a). One example of a propellant is 1,1,1,2-tetrafluoroethane. Other suitable propellants include, for example, $CO_2$ and/or $CO_2$ in combination with other propellants.

Other features and advantages of the present cleaning compositions will be apparent from the following detailed description, in conjunction with the appended claims.

DETAILED DESCRIPTION

While the present disclosure is susceptible of embodiment in various forms, there is hereinafter described presently preferred embodiments with the understanding that the present disclosure is to be considered an exemplification and is not intended to limit the invention to the specific embodiments described.

A nonflammable ternary cleaning composition or cleaner is formulated from a combination of first, second and third solvents. In one formulation, the first solvent is dichloroethylene, the second solvent is a hydrofluorocarbon, an the third solvent is a fluoroketone. In a present formulation, the first solvent is trans 1,2 dichloroethylene, the second solvent is trans-1-chloro-3,3,3-trifluoropropene and the third solvent is 1,1,1,2,2,4,5,5,5-nonafluoro-4-(trifluoromethyl)-3-pentanone.

The first solvent, trans 1,2 dichloroethylene is present in a concentration of about 50% to about 60% by weight of the cleaner. The second solvent, the hydrofluorocarbon, is trans-1-chloro-3,3,3-trifluoropropene and is present in a concentration of about 25% to about 35% by weight of the cleaner and the third solvent, the fluoroketone, is 1,1,1,2,2,4,5,5,5-nonafluoro-4-(trifluoromethyl)-3-pentanone and is present in a concentration of about 13% to about 25% by weight of the cleaner.

The cleaner can be formulated for use as a liquid, e.g., direct application, or it can be formulated for use as an aerosol. In one aerosol formulation, the propellant is a hydrofluorocarbon (HFC) liquefied gas. Preferably, the HFC liquefied gas is 1,1,1,2 tetrafluoroethane (HFC-134a), present in a concentration of about 10 percent to about 50 percent by weight of the total weight of the cleaner and the propellant. However, in order to reduce the "freezing" effect that may be exhibited by aerosol cleaners, the propellant concentration may be reduced to about 10 percent. In such cases, carbon dioxide may also be used to assist the hydrocarbon propellant.

It has been found that a nonflammable ternary cleaning composition in accordance with the present disclosure can be used in a wide variety of applications. For example, the present cleaner can be used for direct (e.g., direct liquid application) and indirect (e.g., aerosol application) cleaning of electrical components including printed circuit boards, connectors, relays and contacts, solenoids, motors and motor windings, circuit breakers, circuit breaker panels, transformers, electrical and data communication connectors and switching devices, electronic controls, timers, cable assemblies, splices and terminations, hydraulic and pneumatic equipment, magnetic equipment, fiber optics and the like.

It has been observed that the present cleaner, which provides a range of concentrations of the various solvents, can be formulated having varying degrees of aggressiveness, while at the same time, maintaining non-flammable characteristics.

Those skilled in the art will appreciate that the first solvent, namely the dichloroethylene, exhibits strongly aggressive solvent properties. As such, it has been found that although the dichloroethylene could, in sufficiently high concentrations adversely affect the integrity of certain plastics and polymers, when used in combination with the selected hydrofluorocarbon (e.g., the second solvent), the aggressive tendencies of the solvent are tempered and the solvent as formulated is acceptable for use in essentially all of the electrical, electro-mechanical and mechanical applications as noted above.

Accordingly, the second solvent, the hydrofluorocarbon, exhibits relatively good solvent properties, but generally lacks aggressiveness. This provides application in that it precludes or limits the degradation of plastics and other polymerics, such as that which may be used as substrates in the manufacture of printed circuit boards and components. Thus, the combination of the first and second solvents provides a good balance between the strongly aggressive dichloroethylene and the less aggressive hydrofluorocarbon.

As will be appreciated by those skilled in the art that both the dichloroethylene (e.g., the trans-1,2-dichloroethylene) and the hydrofluorocarbon (e.g., the trans-1-chloro-3,3,3-trifluoropropene) are flammable. As such, one drawback of this binary combination is that the combination of these constituents creates an otherwise flammable mixture that is not likely recommended for use with "live" electrical equipment.

It has, however been found that the use of the third solvent, namely the fluoroketone (e.g., 1,1,1,2,2,4,5,5,5-nonafluoro-4-(trifluoromethyl)-3-pentanone) provides additional solvent characteristics while at the same time reducing the overall flammability of the cleaner, such that the cleaner is non-flammable. As such, it has been found that the unique combination of solvents provides what appears to be (or exhibits the characteristics of) an azeotropic cleaner formulation in which the aggressiveness of the cleaner can be varied to suit a desired application and that has a reduced flammability permitting use on "live" electrical equipment.

Although the third solvent, e.g., the fluoroketone, does, in fact, exhibit solvent characteristics, it is less aggressive than the first and second solvents. Nevertheless, it adds the benefit of reducing the flammability of the solvent overall. To this end, evaluations were made to determine whether the solvent formulation exhibited sufficient azeotropic characteristics necessary for the cleaning solvent to maintain its cleaning ability as well as to provide flame suppression.

Six formulations of cleaning compositions were tested to determine whether they exhibited azeotropic characteristics.

A known standard cleaning composition was formulated from trans 1, 2 dichloroethylene at a concentration of about 50% to 60% by weight of the cleaner, 1,1,1,3,3-pentafluorobutane at a concentration of about 25% to 35% by weight of the cleaner and 3,3-dichloro-1,1,1,2,2-pentafluoropropane (HCFC-225ca)/1,3-dichloro-1,1,2,2,3-pentafluoropropane (HCFC-225cb) at a concentration of about 13% to 25% by weight of the cleaner, commercially available from ITW Chemtronics of Kennesaw, Ga. under the trademark ELECTRO-WASH®.

A first test cleaning composition was formulated from trans 1, 2 dichloroethylene at a concentration of about 50% to 60% by weight of the cleaner, 1,1,1,3,3-pentafluorobutane at a concentration of about 25% to 35% by weight of the cleaner and a DuPont HFX-110 (MPHE) at a concentration of about 13% to 25% by weight of the cleaner.

A second test cleaning composition was formulated from trans 1, 2 dichloroethylene at a concentration of about 50% to 60% by weight of the cleaner, 1,1,1,3,3-pentafluorobutane at a concentration of about 25% to 35% by weight of the cleaner, and ethyl nonafluoroisobutyl ether/ethyl nonfluorobutyl ether at a concentration of about 13% to 25% by weight of the cleaner.

A third test cleaning composition was formulated from trans 1, 2 dichloroethylene at a concentration of about 50% to 60% by weight of the cleaner, 1,1,1,3,3-pentafluorobutane at a concentration of about 25% to 35% by weight of the cleaner, and 1,1,1,2,2,4,5,5,5-nonafluoro-4-(trifluoromethyl)-3-pentanone at a concentration of about 13% to 25% by weight of the cleaner.

A fourth test cleaning composition, which is an embodiment of the present nonflammable ternary cleaning composition, exhibited what appeared to be azeotropic behavior and was formulated from trans 1, 2 dichloroethylene at a concentration of about 50% to 60% by weight of the cleaner, trans-1-chloro-3,3,3-trifluoropropene, at a concentration of about 25% to 35% by weight of the cleaner, and 1,1,1,2,2,4,5,5,5-nonafluoro-4-(trifluoromethyl)-3-pentanone at a concentration of about 13% to 25% by weight of the cleaner. The fluoroketone, that is, the 1,1,1,2,2,4,5,5,5-nonafluoro-4-(trifluoromethyl)-3-pentanone, is for example, that commercially available under the trademark NOVEC®649 (L-22229).

A fifth test cleaning composition was formulated from trans 1, 2 dichloroethylene at a concentration of about 50% to 60% by weight of the cleaner, DuPont (Chemours) HFX-110 (MPHE) methoxytridecafluoroheptene, and/or HFX-1100 (HFO-1336mzz) (Z)-1,1,1,4,4,4-hexafluorobut-2-ene; cis-1,1,1,4,4,4,-hexafluorobut-2-ene at a concentration of about 25% to 35% by weight of the cleaner, and 1,1,1,2,2,4,5,5,5-nonafluoro-4-(trifluoromethyl)-3-pentanone at a concentration of about 13% to 25% by weight of the cleaner.

All of the tested cleaning compositions functioned well to perform the required cleaning They all exhibited acceptable cleaning characteristics while avoiding the overly aggressive tendencies that would otherwise be detrimental to polymer substrates and the like, and still provided flammability suppression.

It was found, however, that the first, second, third and fifth test compositions noted above were not azeotropic formulations. That is, their compositions were not constant over a range of liquid and vapor phases. The fourth test compositions did, however, appeared to exhibit azeotropic behavior or characteristics in that the concentrations of the constituents were relatively constant over the liquid and vapor phases.

In further evaluation of the fourth test composition (i.e., an embodiment of the present nonflammable ternary cleaning composition), it was found that prior to distillation, the cleaning composition had a density of 1.2899 to 1.2876 gm/cc and a boiling point of about 100-120 degrees F. (about 30-48.9 degrees C.), and that after distillation, the cleaning composition had a density of 1.2887 gm/cc and a boiling point of about 107 degrees F. (about 42 degrees C.).

As set forth above, the present cleaner can be used in liquid form in direct cleaning, and can also be provided as an aerosol. When provided in aerosol form, various propellants can be used. For example, an HFC liquefied propellant, as well as, or in addition to, carbon dioxide can be used. A preferred propellant for use in the cleaner is an HFC liquefied gas. One suitable propellant is tetrafluoroethane (HFC-134a). Another suitable propellant is trans-1,3,3,3-tetrafluoroprop-1-ene (HFO-1234ze). When used, the propellant is present in a concentration of about 1 percent to about 50 percent by weight of the total weight of the cleaner and the propellant. In that the propellant can produce a freezing effect, it may be desirable for a particular application to maintain the propellant concentration as low as is reasonably achievable, about 1 percent to about 10 percent, in which case, carbon dioxide ($CO_2$) may be used as a suitable propellant or used in combination with other propellants.

It was found that each of these compositions functioned well as a cleaner, while avoiding the overly aggressive tendencies that would otherwise be detrimental to polymer substrates and the like, and still provided flammability suppression. In addition, all of the tested solvents (and the standard) exhibited low GWP.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A non-flammable, ternary liquid cleaner, comprising:

a first solvent being a dichloroethylene;

a second solvent being a hydrofluorocarbon;

a third solvent being a fluoroketone having low flammability, wherein the first solvent is present in a concentration of at about 50 percent to about 60 percent by weight of the cleaner, the second solvent is present in a concentration of about 25 percent to about 35 percent by weight of the cleaner and the third solvent is present in a concentration of at about 13 percent to about 25 percent by weight of the cleaner, and wherein the cleaner is non-flammable.

2. The cleaner in accordance with claim 1 wherein the dichloroethylene is trans-1,2-dichloroethylene.

3. The cleaner in accordance with claim 1 wherein the hydrofluorocarbon is trans-1-chloro-3,3,3-trifluoropropene.

4. The cleaner in accordance with claim 1 wherein the hydrofluorocarbon is methoxytridecafluoroheptene (HFX-110) or HFX-1100 (HFO-1336mzz) (Z)-1,1,1,4,4,4-hexafluorobut-2-ene; cis-1,1,1,4,4,4,-hexafluorobut-2-ene or a combination thereof.

5. The cleaner in accordance with claim 1 wherein the fluoroketone is 1,1,1,2,2,4,5,5,5-nonafluoro-4-(trifluoromethyl)-3-pentanone.

6. The cleaner in accordance with claim 1 wherein the cleaner is formulated as an aerosol and includes a propellant.

7. The cleaner in accordance with claim 6 wherein the propellant is present is a concentration of 1 percent to about 50 percent of a total weight of the cleaner and the propellant.

8. The cleaner in accordance with claim 7 wherein the propellant is an HFC liquefied gas.

9. The cleaner in accordance with claim 8 wherein the HFC liquefied gas is tetrafluoroethane.

10. The cleaner in accordance with claim 8 wherein the HFO liquefied gas is trans-1,3,3,3-tetrafluoroprop-1-ene.

11. The cleaner in accordance with claim 6 wherein the propellant is $CO_2$ or $CO_2$ in combination with an HFC or HFO liquefied gas.

* * * * *